US005957788A

United States Patent [19]

Eze

[11] Patent Number: 5,957,788

[45] Date of Patent: Sep. 28, 1999

[54] SPORTS PRACTICE APPARATUS

[76] Inventor: Obi Walter Eze, 1019 Pensacola St., Foster City, Calif. 94404

[21] Appl. No.: 08/831,042

[22] Filed: Apr. 1, 1997

[51] Int. Cl.[6] ..... A63B 69/00

[52] U.S. Cl. ..... 473/422; 473/423; 473/453; 473/459

[58] Field of Search ..... 473/422, 139, 473/423, 427, 429, 428, 441, 446, 451, 453, 459

[56] References Cited

U.S. PATENT DOCUMENTS

| | | | |
|---|---|---|---|
| 1,581,402 | 4/1926 | Penfrase | 473/139 |
| 3,144,251 | 8/1964 | Gainey | 473/441 |
| 3,329,428 | 7/1967 | Moran | 473/441 |
| 3,333,847 | 8/1967 | Pennington . | |
| 3,365,947 | 1/1968 | Janich | 473/441 |
| 3,427,021 | 2/1969 | Donato | 473/441 |
| 3,514,105 | 5/1970 | Pillard | 473/441 |
| 3,578,324 | 5/1971 | Alvey | 473/441 |
| 3,588,104 | 6/1971 | Griffin . | |
| 3,674,265 | 7/1972 | Sheets | 473/441 |
| 3,677,552 | 7/1972 | Werft | 473/139 |
| 3,897,060 | 7/1975 | Jennings | 473/441 |
| 3,937,464 | 2/1976 | Zalewski | 473/428 |
| 4,042,237 | 8/1977 | Moraru | 473/429 |
| 4,258,916 | 3/1981 | Beam . | |
| 4,641,834 | 2/1987 | Hegedus | 473/446 |
| 4,767,121 | 8/1988 | Tonner | 473/441 |
| 4,815,735 | 3/1989 | McClenny . | |
| 4,907,801 | 3/1990 | Kopp | 473/423 |
| 5,228,683 | 7/1993 | Beimel . | |
| 5,386,988 | 2/1995 | Sung et al. . | |
| 5,435,572 | 7/1995 | Covel | 473/423 |
| 5,711,724 | 1/1998 | McGovern | 473/427 |

*Primary Examiner*—William H. Grieb

*Attorney, Agent, or Firm*—Henry G. Kohlmann; Snell & Wilmer

[57] ABSTRACT

Apparatus for practicing a wide range of sports is disclosed, and comprises a frame with an upstanding support standard from which a support arm projects. A rotatable hub is mounted on the support arm, and a vertically depending suspension rod depends from the hub. An extensible set of telescopically nested cylinders is mounted horizontally at the lower end of the suspension rod. An extensible central rod within the cylinders supports a target object on a presentation stalk. The target object can simulate any kind of ball or other sports object normally hit, caught or otherwise contacted in normal play. In an electromechanical embodiment, a motor engaged through gears to the suspension rod permits the nested cylinders, and thus the target object, to be raised or lowered. A motor within the outermost nested cylinder engaged through gears, a pulley and cable to the central rod permits the central rod to be rapidly retracted, along with all intermediate cylinders into the outermost cylinder. A clutch permits the pulley to be disengaged from the motor so that the central rod and its cable may be pulled out freely. A performance monitoring embodiment includes motion and position sensors associated with the target object, a video monitor mounted on a standard upstanding from the frame, and a control box to which both the sensors and the video monitor are connected.

20 Claims, 12 Drawing Sheets

SPORTS PRACTICE APPARATUS

BACKGROUND OF THE INVENTION

1. Field of the Invention

The present invention relates generally to apparatus for practicing sports, and more specifically to apparatus for practicing and developing hand-eye coordination in sports wherein a player interacts with a target object, such as a ball, as by intercepting the target object while it is moving, or by striking the target object while it is moving or stationary.

2. Description of the Related Art

Prior devices for practicing the types of sports which require hand-eye coordination and interaction with a target object fall within several different categories. A first category of devices includes a wide variety of devices generally referred to as "swing-balls." Swing balls are hand-operated devices comprised of an object ball and a tether; presentation of the object ball to a practicing user is accomplished by swinging the object ball in a circular arc on the end of the tether while the practicing user stands just outside the arc and attempts to strike or otherwise intercept the object ball. Examples of swing balls are shown in: U.S. Pat. No. 2,547,776 issued to Rankin in 1944 for a batting practice device which includes means for adjusting the radius of the ball's arc; Austrian Patent No. 204,451 issued to Gerber and Bigler in 1956 showing a kick-ball on a tether; and, U.S. Pat. No. 3,907,287 issued to Fox, et al. in 1975 showing a spring incorporated between a handle and ball-retaining string. Other swing-balls are shown in U.S. Pat. No. 3,637,209 issued to Raut in 1972; and, in U.S. Pat. No. 2,942,883 issued to Moore in 1960. Related devices are shown in U.S. Pat. No. 4,577,864 issued to Aldrich in 1986; U.S. Pat. No. 4,816,921 issued to Fox in 1980; and, U.S. Pat. No. 4,415,155 issued to Goudreau, et al. in 1983.

One primary drawback of swing ball-type apparatus is that a practicing user cannot operate the apparatus and practice at the same time; a second person is needed. Other drawbacks include the unnatural, arced path of the object ball, and the propensity of the practicing user's bat, racquet or the like getting tangled in the tether when the object ball is missed.

A second category of practice devices includes those which present a stationary object ball. These include upright flexible tubular ball supports such as are commonly used in children's baseball-like games known as "T-ball." Even common golf tees fall in this category. Other somewhat more complex stationary object ball-presentation devices are shown in: U.S. Pat. Nos. 5,368,988; 3,937,464; 4,907,801; and, 4,258,916. One drawback in this category includes the inability of a practicing user to develop hand-eye coordination for moving objects. Another drawback is that such devices are unlikely to give the practicing user the authentic feel of hitting a ball in actual play. In the more complex devices in this category, this is due to the use of coil springs, resilient tethers and the like, which simulate poorly the resistance of an actual ball in play, and the fact that, with such devices, the path of travel of the object ball is limited in one or more directions.

A third category of devices includes those which present a moving object ball. Devices which present the object ball moving in an arc in a horizontal plane include those disclosed in U.S. Pat. Nos. 3,588,104; 4,815,735; and, 3,333,874. A device which presents an object ball traveling randomly in a vertical path, and, when hit, pivots on an arm in a vertical plane, is shown in U.S. Pat. No. 5,228,683. Problems with devices in this third category likely include the unnatural path or arc of the object ball, either in its presentation, or in its travel after being hit; and, the unnatural feel of the ball in connection with the apparatus.

Yet a fourth category of devices includes conventional ball pitching machines, and the like, such as are utilized in arcade batting cages. Drawbacks in the use of these include their inability to present a stationary target object, and their inability to present different target objects without significant modification.

Thus, it appears that a need exists for sports practice apparatus able to present a target object to a practicing user in either a stationary mode or in a moving mode. It would also be advantageous if such apparatus had the ability to present the target object at any height, from the ground up; and, at any trajectory, moving toward the practicing user. Yet further, such apparatus should permit the user to evaluate his or her own performance and skill level in a manner which has true relevance to the user's likely level of performance in actual play.

SUMMARY OF THE INVENTION

The sports practice apparatus of the present invention is adapted to overcome the above-noted shortcomings and to fulfill the stated needs. It comprises: a frame; a target object; telescopically extensible means between the target object and the frame for presenting the target object to a user; and, means for causing or permitting the telescopically extensible presenting means, once extended, to contract or extend in length, rapidly.

In its simplest form, this may be a wholly mechanical apparatus. This mechanical embodiment is manually manipulable to permit a practicing user to: place the target object thereof in a particular starting position; then, to strike the target object; and then, to return the target object to the starting position for a second, virtually identical, practice stroke. Or, if desired, the target object may be positioned to practice a different stroke.

In contrast, an electromechanical version of the apparatus includes variable speed, reversible motors and cooperating drive trains engaged with the apparatus' elements to permit a practicing user to create dynamic simulations of actual play for sports wherein a player normally encounters moving target objects.

And, in yet a further embodiment, the capability of evaluating a practicing user's performance is made possible by the addition of: motion and position sensors embedded in the apparatus' various mechanical elements; data storage and retrieval apparatus in communication with the motion and position sensors; and, a video monitor in communication with the data storage and retrieval apparatus.

It is an object of the present invention to provide sports practice apparatus useful in practicing a great variety of different sports.

It is a further object of the present invention to provide sports practice apparatus able to present a moving target object as well as a stationary target object.

Yet another object of this invention is to provide sports practice apparatus able to present to a practicing user a moving target object which follows a path or trajectory similar to that followed in normal play by the ball or other sports object which the target object represents.

Yet a further object of the present invention is to provide sports practice apparatus wherein resistance against the movement of, and/or against the change of direction of, a target object may be increased or otherwise adjusted to keep practice challenging through a practicing user's increasing skill levels.

Still a further object of the present invention is to provide sports practice apparatus able to record a practicing user's performance in striking or otherwise intercepting a target object.

Still further objects of the inventive sports practice apparatus disclosed herein will be apparent from the drawings and following detailed description thereof.

DESCRIPTION OF THE PREFERRED EMBODIMENT

Figure 1:
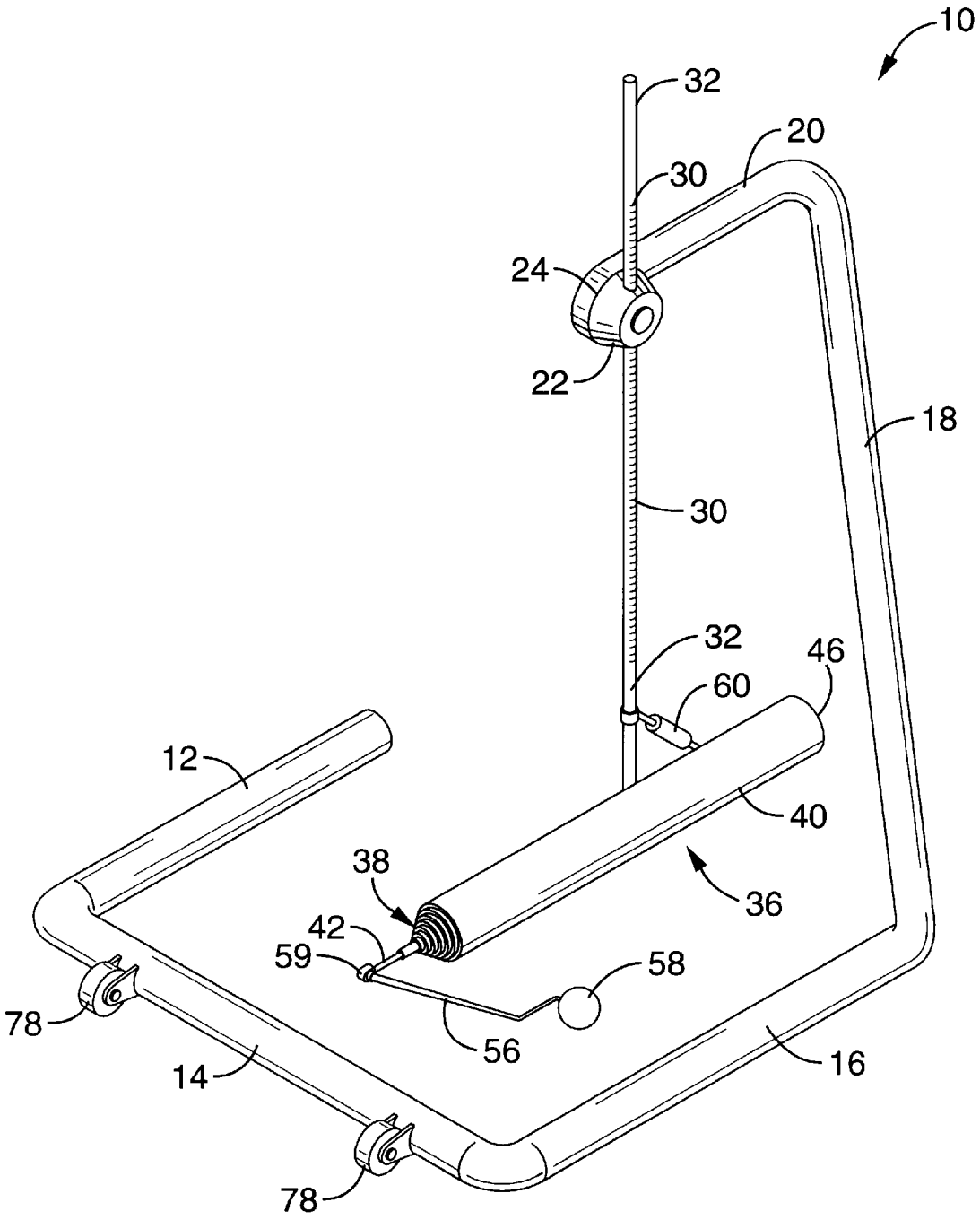
FIG. 1 is a perspective view of the mechanical embodiment of the sports practice apparatus of the invention, from the upper left side thereof.
Figure 2:
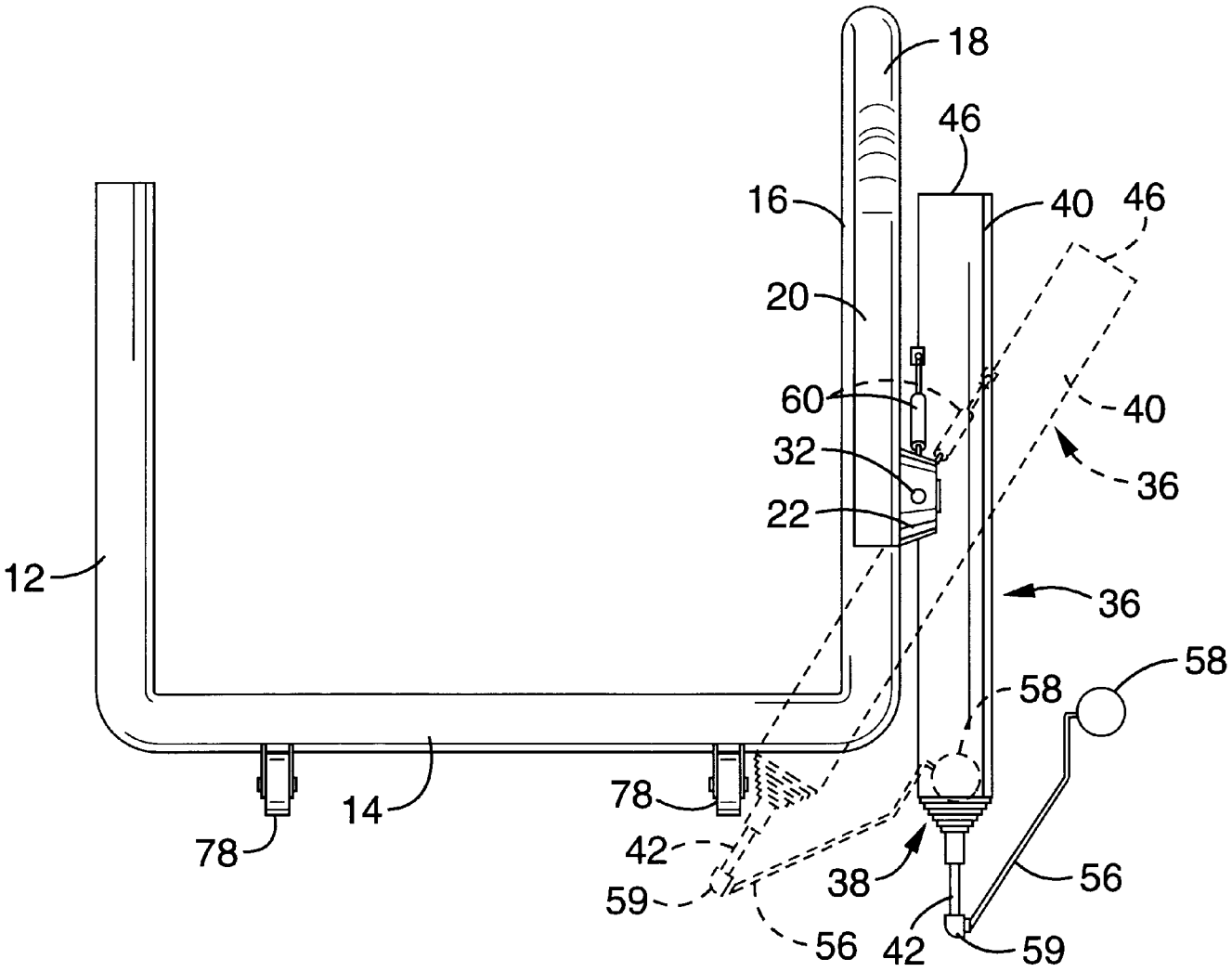
FIG. 2 is a top plan view of the sports practice apparatus of FIG. 1, showing the telescoping cylinder in its home position, and also showing the telescoping cylinder in a yawed, alternative position depicted in phantom line.
Figure 3:
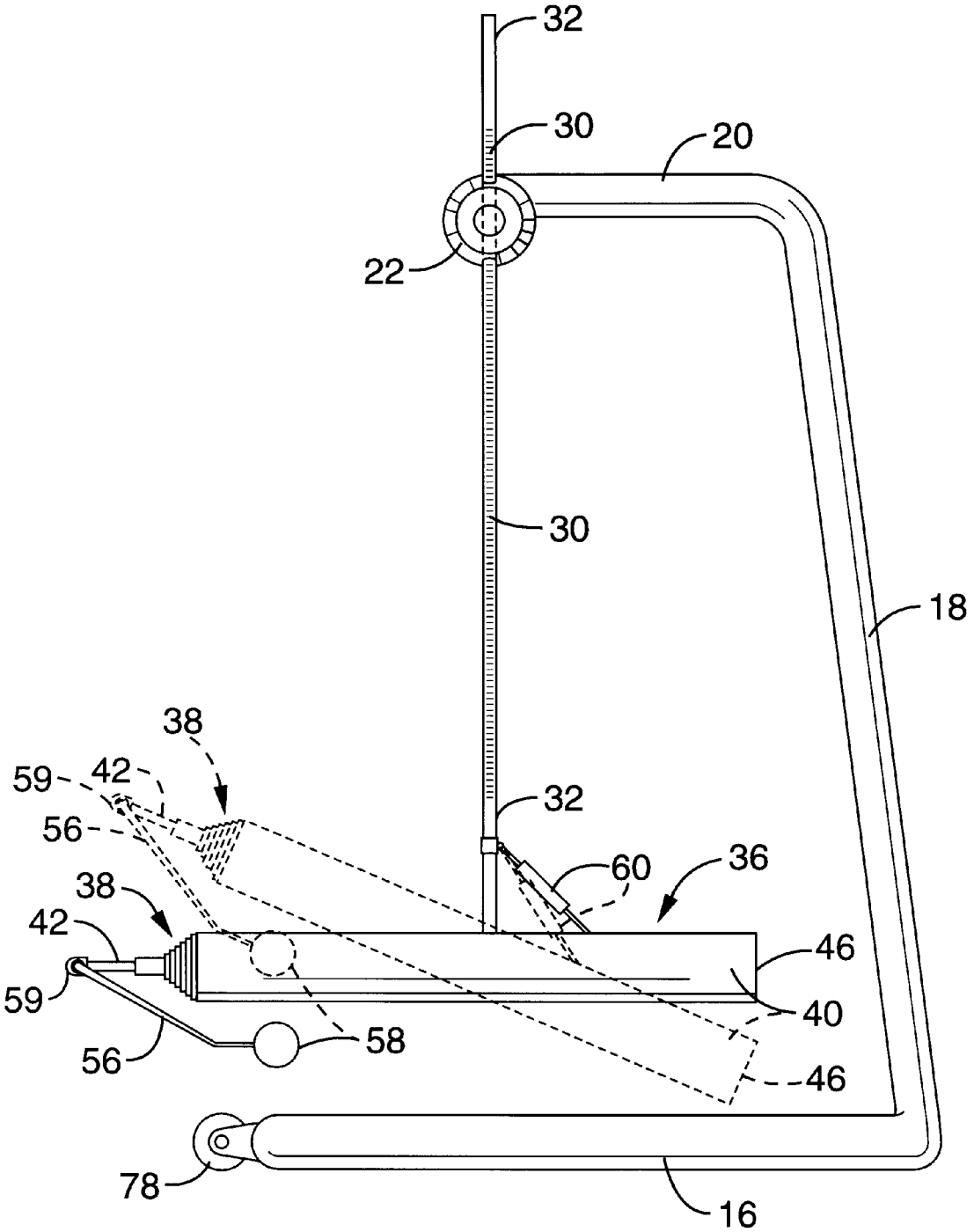
FIG. 3 is a left side elevation of the sports practice apparatus, showing the telescoping cylinder in its home position, and also showing the telescoping cylinder in a pitched, alternative position depicted in phantom line.

Referring now specifically to the drawings, FIGS. 1 through 3 show the general structure of the mechanical embodiment of the sports practice apparatus of the invention, which is generally identified herein with the reference numeral 10. The frame of apparatus 10 is comprised of a lowermost U-shaped portion which is comprised of right side base bar 12, front cross base bar 14 and left side base bar 16. Bars 12, 14 and 16 all reside in the same plane.

Support standard 18 projects upward from the rearward end of left side bar 16. Support standard 18's upper end tilts toward the front side of apparatus 10, but support standard 18 is preferably in the same plane as left side bar 16. Support arm 20 projects generally horizontally toward the front of apparatus 10 from the upper end of support standard 18.

A hub 22 is mounted on the left side of the forward end of support arm 20. Hub 22 is frusto-conical in shape, its wider, base portion being to the left and its narrower, apical portion being to the right side of apparatus 10. Hub 22 is generally rotationally symmetrical around its central, horizontally-oriented axis. Hub 22 is mounted on support arm 22 so as to rotate about its horizontal axis, although as appears more fully below, hub 22 is preferably engaged with support arm 20 and supported thereupon for rotation at the outer rim of its base portion 24 rather than on a central, horizontal shaft.

Apparatus 10 may be of any desired dimensions, although it is expected to be convenient to construct apparatus 10 such that support arm 20 is approximately at chest height for an average-sized practicing user.

Figure 4:
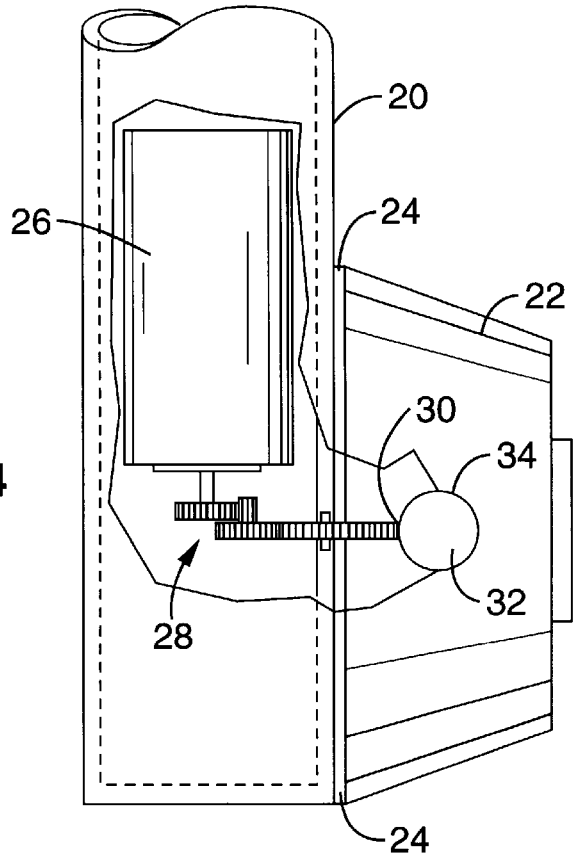
FIG. 4 is a top plan, partially cross-sectional, schematic view of the hub and its mounting on the support arm.
Figure 5:
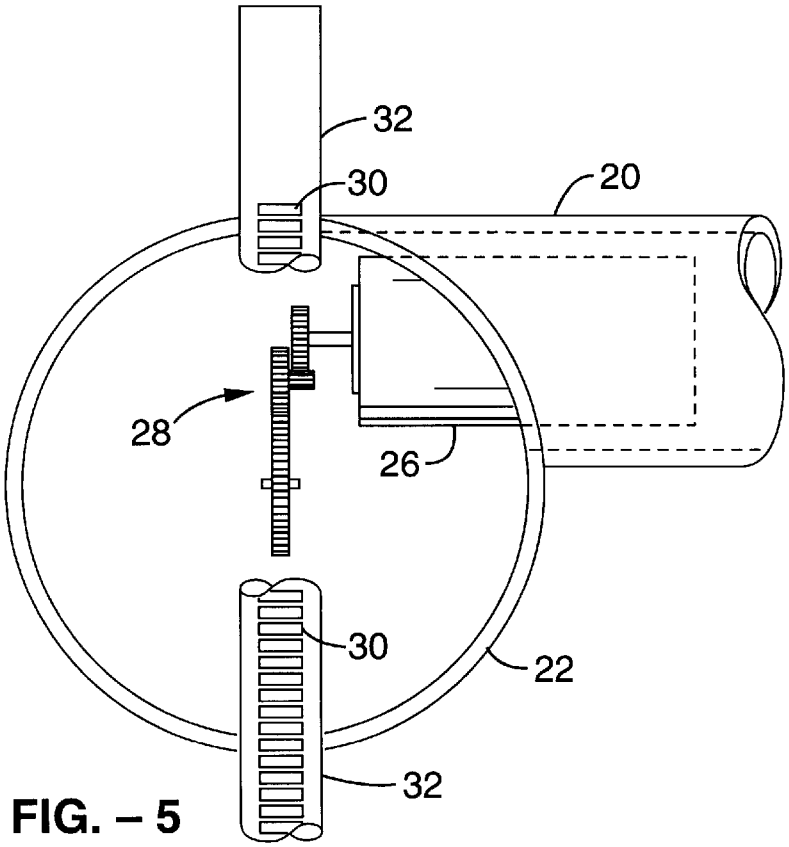
FIG. 5 is a side elevational, schematic view of the gear train and motor in the distal end of the support arm.

As shown in FIGS. 4 and 5, if apparatus 10 is electromechanically equipped (such embodiment being more fully discussed below), variable speed, reversible motor 26 mounted near the distal end of support arm 20 drives gear train 28 which is, in turn, engaged with rack teeth 30 on suspension rod 32 which passes through a normally vertically-oriented channel 34 in hub 22. Suspension rod drive motor 26 preferably runs on direct current, although alternating current motors and other types of drive mechanisms may work satisfactorily well in practicing the invention.

The gear of gear train 28 which engages rack teeth 30 most conveniently does so through the center of the wide, right-side base of hub 22; this, therefore, leaves no room for a central pivot shaft for hub 22. Instead, the rim of hub 22's base preferably has a race and bearings which engage a mating annular race (not shown) on the left side of the forward end of support arm 20. A secure, rotatable, low-friction mechanism for mounting hub 22 in this manner may be constructed in several ways well known in the art.

Control of the power, speed and direction of rotation of suspension rod drive motor 26, through gear train 28 and to rack teeth 30, permits suspension rod 32 to be passed up and down in reciprocating fashion through channel 34 in hub 22. The motion of suspension rod 32 is normally axially directed, i.e. along a vertically-oriented axis when hub 22 is in its home position. However, as hub 22 can rotate about its own horizontal axis, in order to maintain the engagement between gear train 28 and rack teeth 30 as hub 22 rotates, suspension rod drive motor 26 and gear train 28 are preferably constructed, and mounted within support arm 20, so as to rotate with hub 22. Such construction could include relief windows in support arm 20, or other means within the skill in the art for accomplishing the same result.

As hub 22 rotates about its horizontal axis, suspension rod 32 swings through an arc in a vertical plane. Suspension rod 32 swings, as described, in response to torque being applied transverse to its length, anywhere along its length. Hub 22 preferably includes a detent in its rotational travel which aids in its returning to its home position, i.e. that position where cylindrical channel 34 therethrough is vertically oriented.

In a strictly mechanical version of the apparatus, a simple set screw in hub 22 may be employed to fix suspension rod 32, anywhere along its length, with respect to hub 22. And, gravity may simply be relied upon in permitting hub 22 to find its home position.

A telescopically extensible set of nested cylinders, generally referred to herein as the telescopic unit and identified with reference numeral 36, is mounted at the lower end of suspension rod 32. See FIG. 6.

Telescopic unit 36 is mounted on suspension rod 32 with a jointed coupling which permits telescopic unit to pitch as shown in FIG. 3. Any known jointed coupling mechanism suited to the purposes described herein may be employed.

Telescopic unit 36 is comprised of a plurality of successively sized, but otherwise generally identical, intermediate cylinders 38 nested between an outermost casing cylinder 40 and an innermost, extensible, central rod 42. Cylinders 38 and 40, and central rod 42, are engaged with one another with sufficient precision such that they remain as close to being coaxial as possible, even when fully extended and subjected to the full force of gravity, as well as, perhaps, other tangential forces, along their collective length. Such precision in function will likely require incorporation of internal stops to prevent any intermediate cylinder 38, or central rod 40, from projecting over 85–90% of its length beyond the next successively-larger cylinder, i.e. the cylinder in which it is nested and from which it projects. Such stops may include mating longitudinal keys and keyways between adjacent cylinders wherein each such keyway extends only as far as its associated cylinder will be allowed to project beyond the adjacent cylinder. Of course, other similarly-functioning mechanisms, many of which are well-known in the art, may also serve this purpose of a "stop" satisfactorily.

It should be further noted that if mating keys and keyways are employed, some advantageous results may be realized if each keyway is significantly wider than its mating key, such that each cylinder is able to rotate somewhat with respect to its adjacent cylinder or cylinders. Further, each keyway may be lined with a spring mechanism or resilient material to damp rotational movement between the elements of telescopic unit 36. The potentially advantageous results of providing this damped rotational "play" between cylinders are set forth below.

Cylinders 38 and 40 should also be provided with such bearing structures as will minimize friction against full extension of telescopic unit 36, and as will best support cylinders 38 and 40, and central rod 42, against becoming non-coaxial upon full extension.

Figure 6:
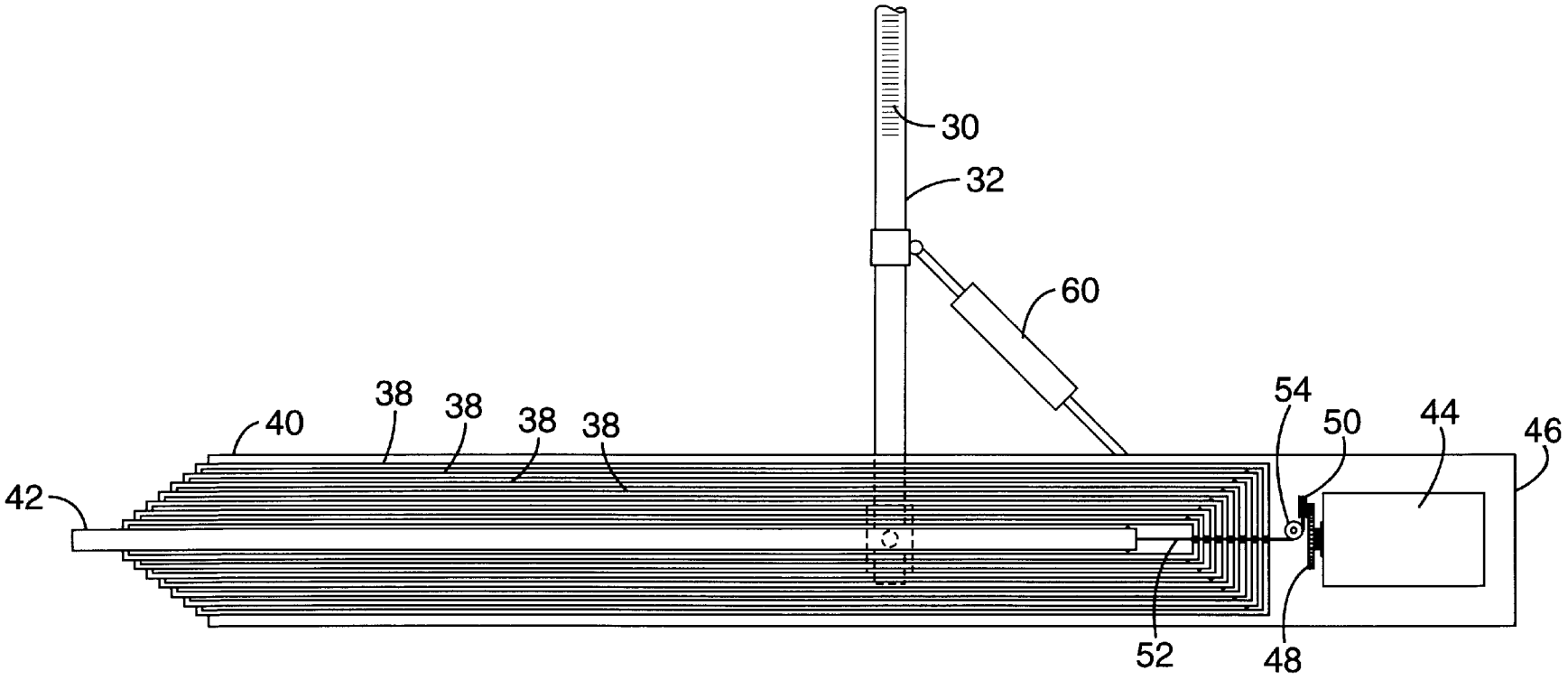
FIG. 6 is a cross-sectional view of the nested cylinders of the telescopic unit.
Figure 7:
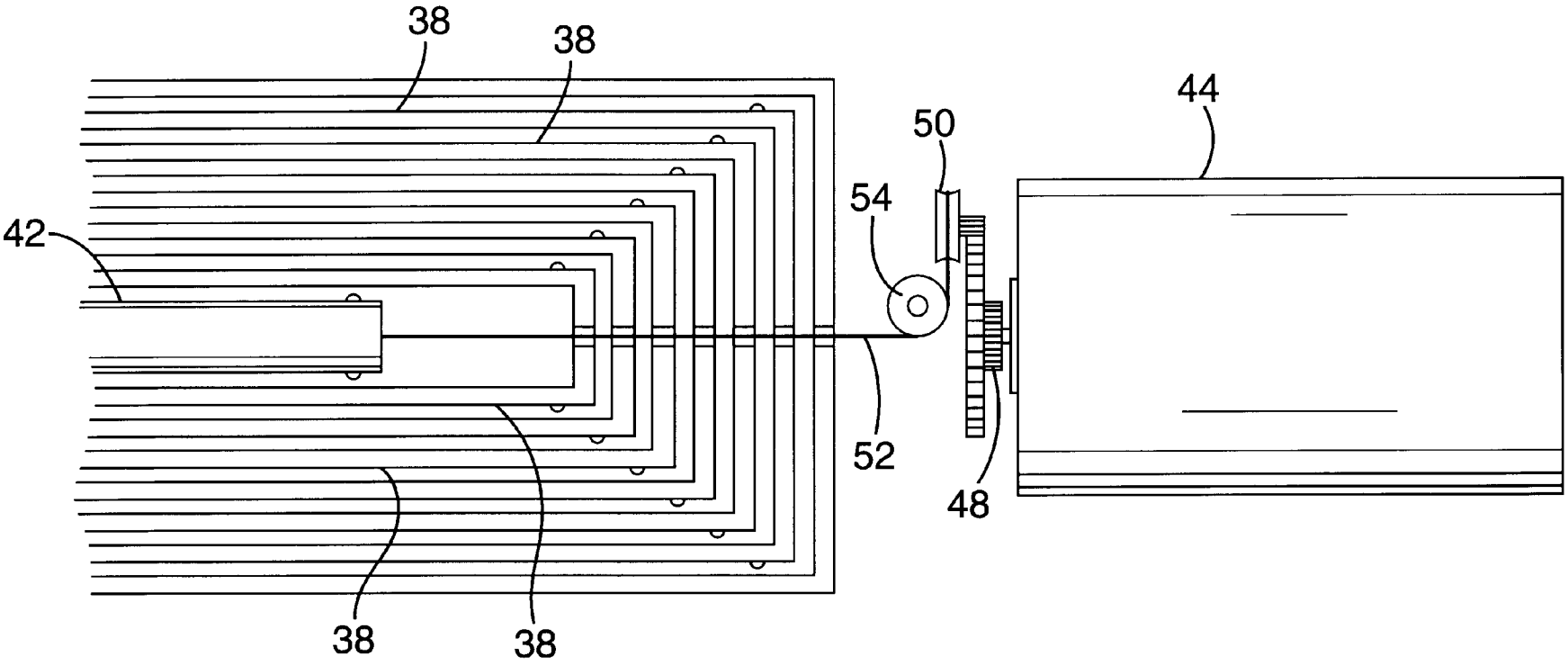
FIG. 7 is an enlarged cross-sectional view of the proximal end of the telescopic unit, showing the motor, gears, spool, cable and pulley therewithin.

As shown in FIGS. 6 and 7, in an electromechanical embodiment of the apparatus, outermost casing cylinder 40 of telescopic unit 36 may have a variable speed motor 44 housed in its proximal end 46. Telescopic unit motor 44 drives gear 48 which, in turn, drives additional intermediate gears (shown but not numbered) as will be known in the art, ultimately causing rotation of cable spool 50. Thin, high tensile strength cable 52, or an equivalent tether, runs from spool 50, around pulley 54 and is securely affixed to the proximal end of central rod 42. When telescopic unit 36 is extended any distance beyond its fully contracted position, operation of telescopic unit motor 44 acts to draw or reel cable 52 and therefore central rod 42 inward and, therefore, to return telescopic unit 36 to its fully contracted position. It is also preferable that means such as a clutch be provided for disengaging motor 44 from cable 52, such means being discussed further below. Disengaging motor 44 from cable 52 should permit central rod 42 to be manually drawn in a direction distal to telescopic unit 36, thus permitting cable 52 to reel out freely, until telescopic unit 36 reaches its fully extended orientation.

The distal end of central rod 42 is fitted with a laterally-projecting presentation stalk 56 which supports a target object such as object ball 58. The object ball 58 shown is a simulated tennis ball, but stalk 56 is preferably constructed so as to accept a wide variety of different types of object balls or other target objects, each being for practicing a different sport. Each target object may be engageable with the distal end of a single universal stalk 56, or each may have its own stalk. If each target object has its own stalk, each such stalk should have a coupling at its proximal end which is engageable with a stalk coupling 59 at the distal end of central rod 42.

Object ball 58 is preferably of the same size, shape, surface texture, density and appearance, and of the same resilience or non-resilience, as a ball used in actual play of the sport or game being practiced. For example, object ball 58 should look and feel like a regulation tennis ball. However, it is expected that a regulation ball or other target object will often not be adequate to achieve the needs of the invention because apparatus 10's elements, which are connected to the target object, will alter the feel of the target object to the practicing user. Thus, the specifications of the target object should be chosen so that the target object has the feel of a regulation ball or object when connected to apparatus 10. Any such target object should also be constructed so as to be able to withstand a long service life of continuous heavy-duty use.

In an electromechanical embodiment of the inventive apparatus (further discussed below), object ball 58 may also include internal or external sensors (not shown) of known types able to transmit information about the location, direction and force of any impact upon ball 58's surface. Any other target object could also include such sensors, as well.

A coil spring (not shown) within hub 22 and coaxial with suspension rod 32, or a mechanically equivalent element, may be employed to cause suspension rod 32, and therefore telescopic unit 36, to self-center as telescopic unit 36 yaws, as in FIG. 2. Alternatively, such a coil spring or other centering element may be disposed between the lower end of suspension rod 32 and telescopic unit 36. Such centering element, of whatever type, will preferably cause telescopic unit 36 to return to parallel alignment with the horizontally-oriented, forward-rearward axis of apparatus 10 whenever telescopic unit 36 is thrown out of alignment therewith, as when object ball 58 is struck by a practicing user.

As shown in FIG. 6, a cylindrical centering element 60 resides at roughly a 45° angle between suspension rod 32 and the proximal end 46 of outermost casing cylinder 40, and tends to keep suspension rod 32 and telescopic unit 36 at right angles to one another as telescopic unit 36 pitches, as in FIG. 3. Centering element 60 is preferably of a known type comprised of a piston within a cylindrical casing, wherein the piston's neutral position is approximately at the middle of the cylinder's length and wherein opposing coil springs lie between the piston and the cylindrical casing's opposed ends. The coil springs may either be resilient against compression or resilient against extension, as long as both are the same. If resilient against extension, each spring would need to have its opposed ends anchored to the piston and to its respective end of the interior of the cylindrical casing.

Figure 8:
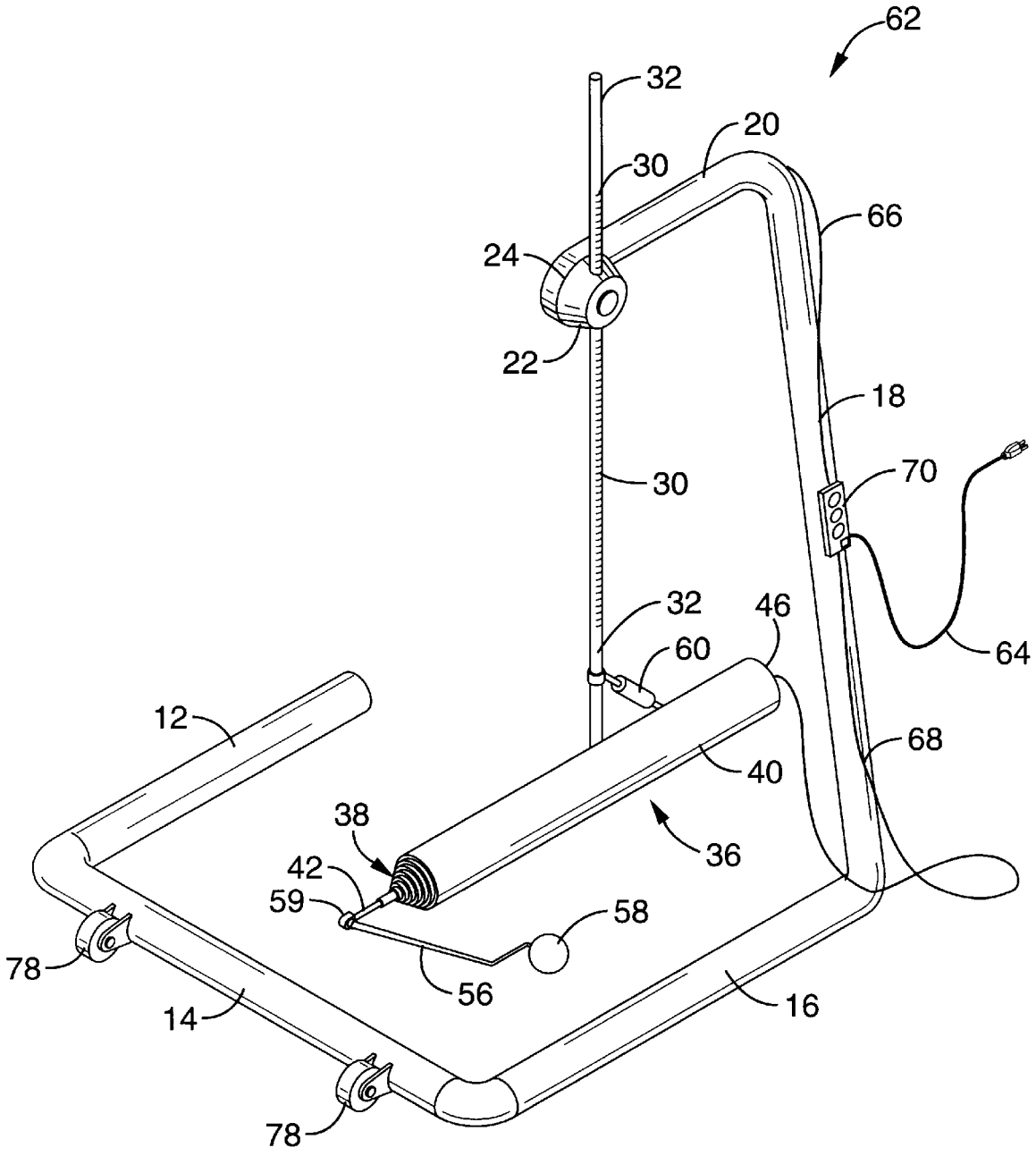
FIG. 8 is a perspective view of the electromechanical embodiment of the inventive sports practice apparatus.

FIG. 8 shows an electromechanical embodiment of the inventive sports practice apparatus, this being generally identified herein with reference numeral 62. Electromechanical apparatus 62 includes motors 26 and 44, gears 28 and 48, spool 50, cable 52, pulley 54, and other elements shown in FIGS. 4, 5 and 7, but these do not necessarily contribute to a great visible difference between apparatus 10 and electromechanical apparatus 62. However, electromechanical apparatus 62 might also include elements which make it visibly different, including primary power cable 64, hub power cable 66 and telescopic unit power cable 68. Primary power cable 64 may be connected to control unit 70, from whence signals may be sent to suspension rod drive motor 26 in hub 22, and to telescopic unit motor 44, via cables 66 and 68, respectively. Of course, power cables 66 and 68 could also run internal to the apparatus.

Figure 9:
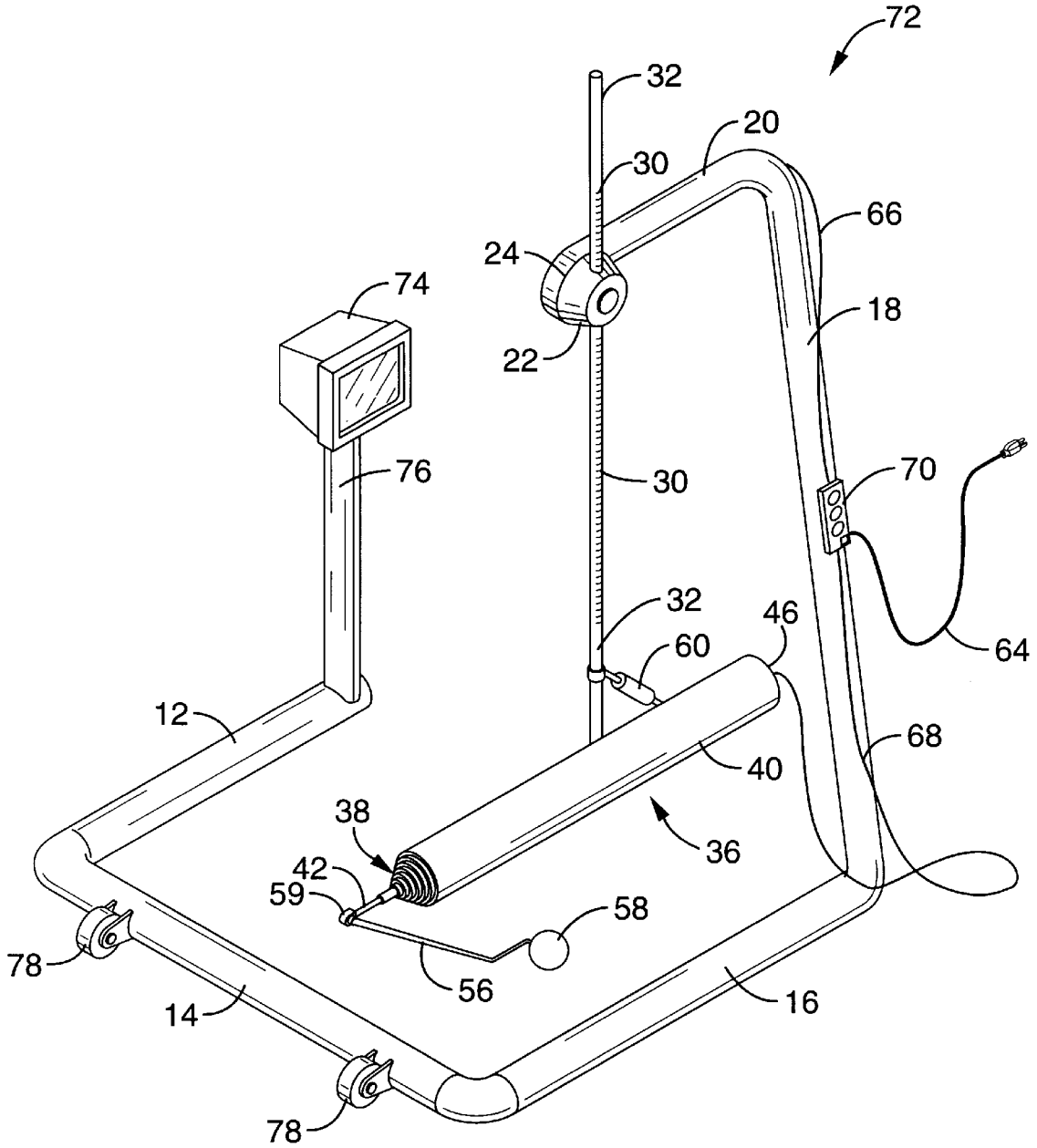
FIG. 9 is a perspective view of the performance-evaluating version of the electromechanical sports practice apparatus.

A performance-evaluating embodiment of the inventive apparatus is shown in FIG. 9, and is generally identified herein with reference numeral 72. Performance-evaluating apparatus includes a video monitor 74 disposed atop video monitor standard 76 which rises vertically from the rearward end of right side base bar 12. Video monitor 74 is preferably in communication with control unit 70 via cable internal to the apparatus.

Figure 10:
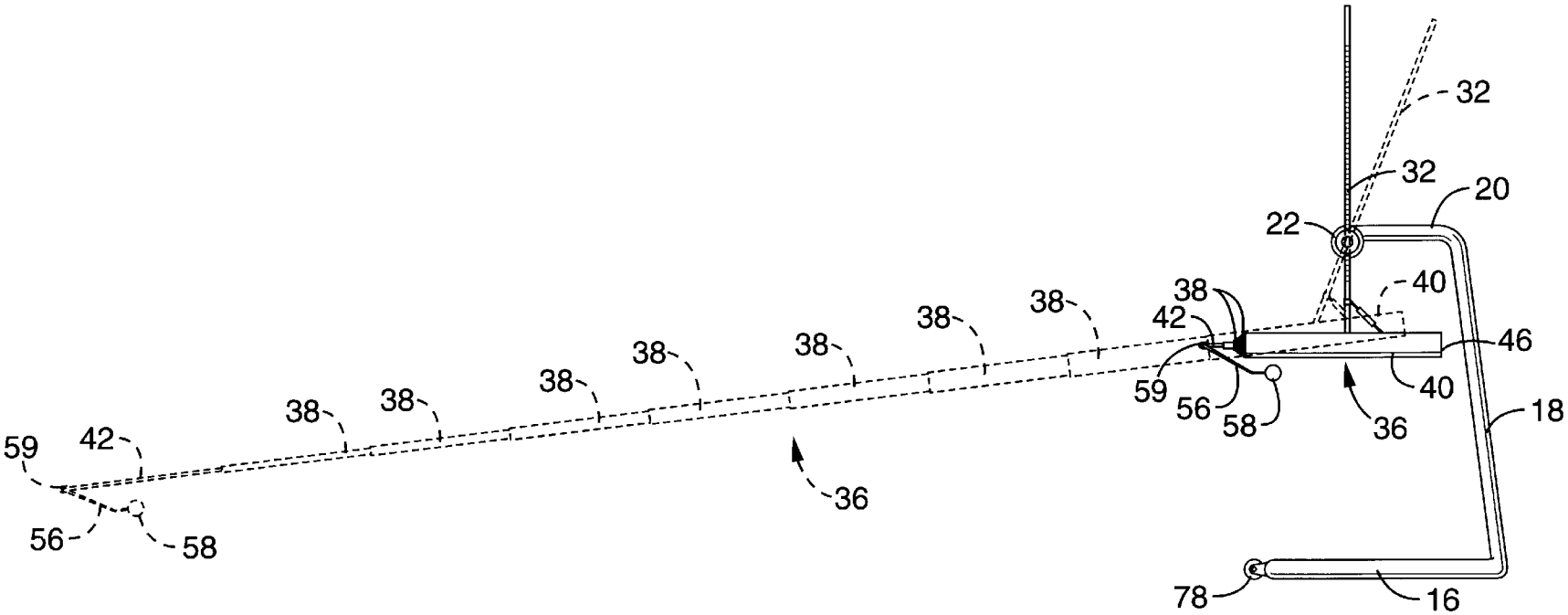
FIG. 10 is a side elevation of the mechanical apparatus of FIG. 1, showing the path of travel of the object ball and the telescopic unit in a static simulation of the return of a tennis shot received at approximately chest level and hit on a downward-sloping angle.

In use of mechanical apparatus 10, a practicing user is able to create a static simulation of actual play by placing object ball 58 in a position likely to be encountered in the game or sport being simulated. The practicing user first prepares the apparatus by manually setting the position of suspension rod 32, and therefore telescopic unit 36 and object ball 58, with respect to hub 22. For example, as shown in FIG. 10, in practicing a tennis stroke simulating the return of a shot wherein the ball is received at approximately chest level, suspension rod 32 is fixed with respect to hub 22 such that telescopic unit 36 is very close to hub 22. Then, as object ball 58 is struck with a tennis racquet, object ball 58 travels away from the face of the racquet, and telescopic unit 36's subunits (intermediate cylinders 38) slide telescopically with respect to one another, thereby simulating the flight path of an actual tennis ball when returned from chest height and hit on a downward-sloping angle. Telescopic unit 36 may also pitch and/or yaw in response to the stroke, thus permitting object ball 58 to follow a path which is as close to natural as possible. This is most important in the early part of the stroke, when the racquet is still accelerating the object ball, and the two are still in contact with one another.

And, if the keys and keyways between cylinders 38 and 40 of telescopic unit 36 are constructed to permit some play therebetween, this will give the practicing user a less rigid, more realistic feel of having executed an unencumbered stroke in actual play. Further, if springs or resilient material are provided between the keys and keyways so as to provide resiliently damped rotational play therebetween, this could aid in best simulating the beginning of a natural flight path, especially if an object ball in actual play would naturally follow a curving path, as occurs when a player successfully imparts spin or "english" to the ball in executing a shot.

After object ball 58 has completed its travel and telescopic unit 36 is fully extended, gravity, and apparatus 10's self-centering elements, would return suspension rod 32 to a vertical orientation and would return telescopic unit to a horizontal orientation parallel with the forward-rearward axis of apparatus 10. Then, the practicing user may prepare for another practice shot by manually collapsing telescopic unit 36 such that all of its subunits are nested together again. Then, an identical practice shot may be taken; or, suspension rod 32 may be set in a different position with respect to hub 22, and a different shot may thereby be simulated.

Figure 11:
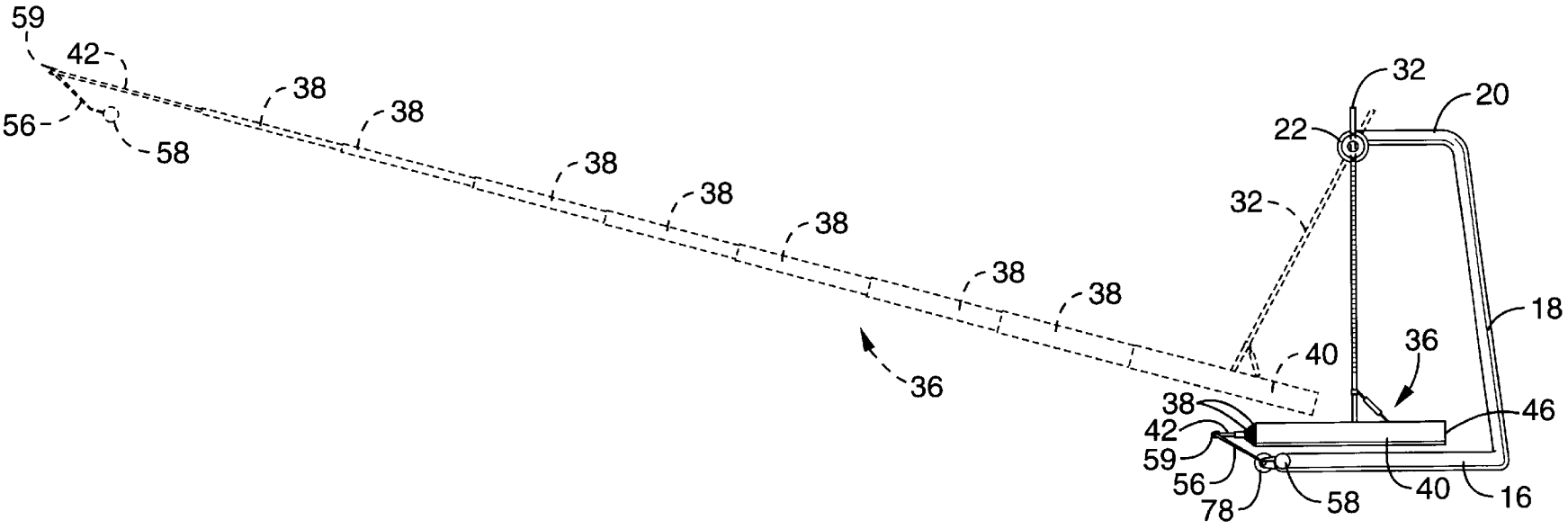
FIG. 11 is a side elevation of the mechanical apparatus of FIG. 1, showing the path of travel of the object ball and the telescopic unit in a static simulation of the return of a tennis shot received close to the ground and hit at an upward-sloping angle.

FIG. 11 shows where telescopic unit 36 and object ball 58 may be set to simulate the return of a tennis shot received at close to ground level and angled upward. This simulation, and the one shown in FIG. 10, would be a static simulations of striking a target object which would normally be moving in actual play. Thus, apparatus 10 does not give the practicing user the ability to practice a stroke against a moving target object and, therefore, to develop the hand-eye coordination that is a product thereof. However, the aspects of apparatus 10's construction that permit the target object to move in three dimensions after being struck give apparatus 10 a significant advantage over other static simulation-practice apparatus employing stationary target objects. Further, the height adjustability of apparatus 10's target object makes it ideal for practicing a sport such as golf wherein the target object in actual play (a regulation golf ball) is normally stationary when struck. Setting up apparatus 10 for such golf practice would merely require exchanging object ball 58 (a simulated tennis ball) for a simulated golf ball (not shown). Then, telescopic unit would be placed in a position similar to that shown in FIG. 11, with the simulated golf ball resting on the underlying supporting surface. Then, the simulated golf ball could be hit with a golf club in a manner very similar to that in actual play. It should be noted that, even if suspension rod 32 is not long enough such that telescopic unit 36 cannot be dropped far enough to come into contact with the underlying supporting surface, central rod 42 should be rotatable within its immediately adjacent intermediate cylinder 38, thus permitting the simulated golf ball, which is supported on projecting presentation stalk 56, to be placed in contact with the supporting underlying surface. And, in any case, it is preferable that telescopic unit 36 not be placed in direct contact with the underlying supporting surface, because this would tend to interfere with telescopic unit 36's action, as well as with the flight path of the target object.

To permit apparatus 10's use in practicing the widest variety of sports, it is preferable that hub 22 be able to be rotated 180° so that suspension rod 32 projects upward from hub 22; and, it is also preferable that telescopic unit 36 be rotatable 180° so that object ball 58 is oriented toward the forward end of apparatus 10. This permits telescopic unit 36 to be disposed at varying distances above hub 22. In the alternative, suspension rod 32 may be removable from hub 22 and re-insertable in hub 22's channel 34 from the top downward. As yet another alternative, telescopic unit 36 could be removable from suspension rod 32's lower end, and replaceable atop suspension rod 32's upper end. With telescopic unit 36 above hub 22, a greater variety of static simulations of shots and strokes, etc. in different games and sports can be practiced. That is, with telescopic unit 36 disposed above hub 22, simulations of overhead and overhand shots and strokes are possible.

Electromechanical apparatus 62 has the same capabilities as mechanical apparatus 10, but also includes the ability to present dynamic simulations of target objects moving as they would in actual play. This is made possible by two types of powered movement of the elements of apparatus 62. Specifically, in apparatus 62, suspension rod 32 can move up and down rapidly with respect to hub 22, thus moving telescopic unit 36 up and down along with suspension rod 32. And, from a fully extended orientation, telescopic unit 36 can contract very rapidly to its fully nested position.

The rapid vertical movement of telescopic unit 36 is made possible by manual or programmed control of suspension rod drive motor 26 from control unit 70. Running motor 26 in one direction drives suspension rod 32 up, and reversing motor 26 drives suspension rod 32 down. Telescopic unit 36, which is mounted on either the top end or the bottom end of suspension rod 32, is driven either up or down along with suspension rod 32.

The rapid contraction of telescopic unit 36 is made possible by manual or programmed control of telescopic unit motor 44 from control unit 70. When telescopic unit 36 is extended any distance from its fully contracted position, operation of telescopic unit motor 44 acts to draw cable 52 and therefore central rod 42 inward and, therefore, to return telescopic unit 36 to its fully contracted position. It is also preferable that means be provided for disengaging motor 44 from cable 52, such means not being shown, but being well within the skill in the art. Disengaging motor 44 from cable 52 should permit central rod 42 to be manually drawn in a direction distal to telescopic unit 36 until telescopic unit 36 reaches its fully extended orientation.

Control unit 70, which controls motors 26 and 44, may simply comprise a panel of selectable switches, and the like (not shown), able to drive suspension rod 32 up and/or down, as desired, at any speed desired. Other switches may control the speed of contraction of telescopic unit 36. Such switches or equivalent controls are within the skill in the art.

Figure 12:
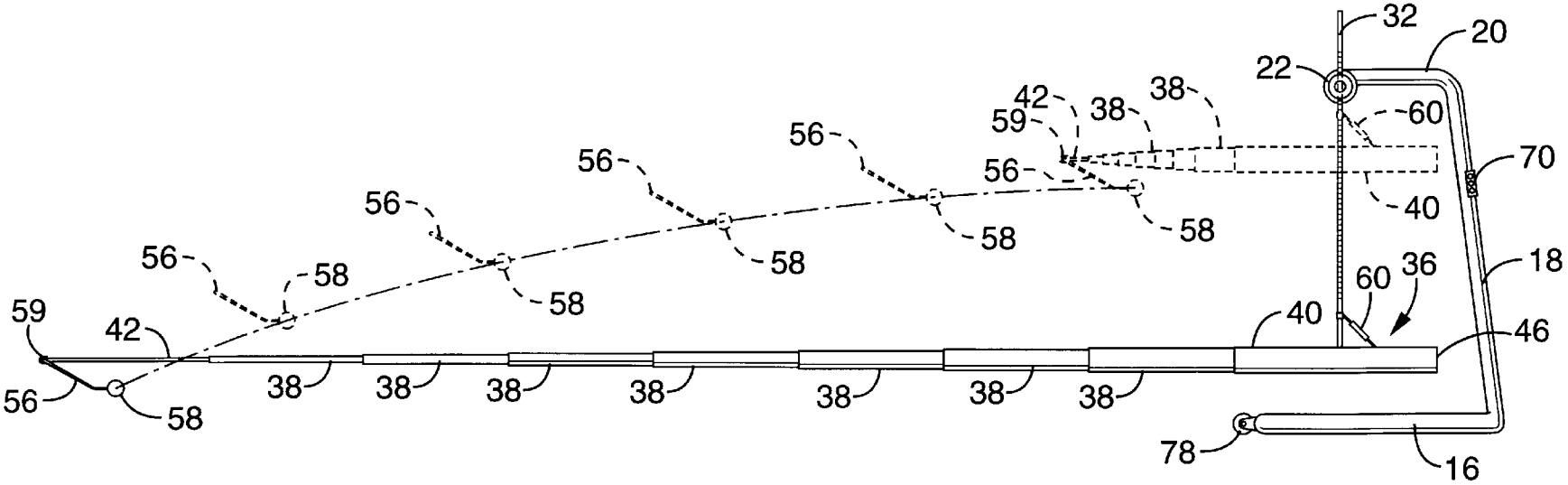
FIG. 12 is a side elevation of the electromechanical apparatus of FIG. 8, showing the path of travel of the object ball and the telescopic unit in a dynamic simulation of a tennis ball returned over a tennis net and bouncing up toward a practicing user.

In combination, the operation of motors 26 and 44 may cause object ball 58 to follow the trajectory of a ball in actual play, thereby providing a practicing user with very realistic dynamic simulations. One example of such a dynamic simulation is shown in FIG. 12, wherein object ball 58 is made to follow a path similar to that of a tennis ball returned over a tennis net and bouncing up toward the practicing user. Initially, the engagement between motor 44 and cable 52 is released so that central rod 42 may be drawn distally from telescopic unit 36, along with stalk 56 and object ball 58, until telescopic unit 36 is in its fully extended orientation. This may be carried out manually. Then, suspension rod drive motor 36 is operated to drop telescopic unit 36 down close to the underlying supporting surface. From this starting position, with object ball 58 down very low and as far forward of apparatus 62 as possible, control unit 70 is then operated such that motor 26 draws suspension rod 32 and telescopic unit 36 upward very quickly. And, at the same time, telescopic unit motor 44 is operated to draw cable 52, and therefore central rod 42, inward, thereby drawing telescopic unit 36 very quickly toward its fully contracted position. As is clear from examination of FIG. 12, the combined effect of running motors 26 and 44 as described is that object ball 58 moves very rapidly in a rearward direction with respect to apparatus 62 and, at once, rapidly rises away from the underlying surface.

Of course, it is preferable that the speed of the horizontal component of ball 58's movement is within the range of that for a returned tennis ball, and it is preferable that the vertical component is similar to that for a bounced tennis ball. These different components may be approximated with fairly simple circuitry. However, for accurate simulation of each component, and especially for the vertical component which may require deceleration in upward travel and acceleration in downward travel, control unit 70 may include programmable circuitry, as well. Such circuitry is preferably in the form of one or more conventional programmable microchips. A control unit 70 comprised of a programmable control unit along with a data storage device would make it possible for a practicing user to direct motors 26 and 44 in ways that cause a particular type of target object to mimic different flight paths encountered in actual play. Indeed, programs for many different flight paths for many different types of target objects could be included.

It may also be beneficial to add several additional elements to the inventive apparatus. For example, a motor or servo may be attached to central rod 42 and may be manipulated to rotate central rod 42 on its axis. This would have the effect of causing object ball 58 to arc on stalk 58 around central rod 42 and, in combination with the horizontal and vertical movement components described above, as well as the damped rotational movement components, could be valuable to simulating curving flight paths as are encountered by players in baseball, tennis and several other games.

Figure 13:
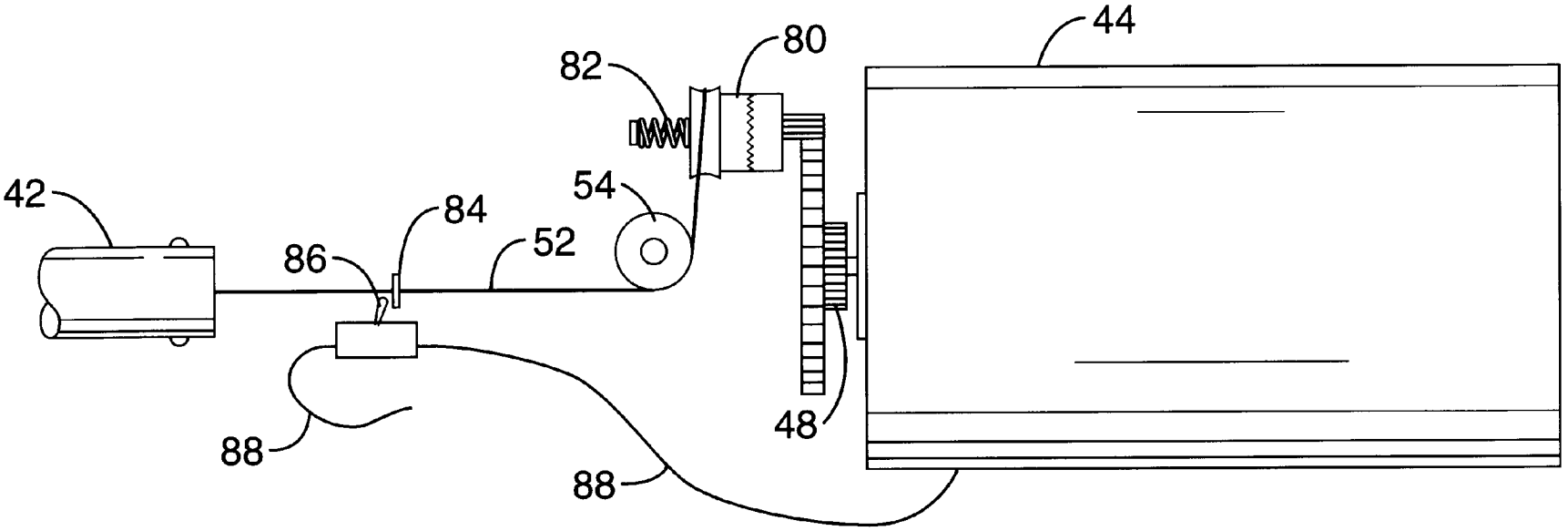
FIG. 13 is an enlarged cross-sectional view similar to that in FIG. 7, showing an alternative version of the proximal end of the telescopic unit including an inertial clutch and a cable-mounted motor control trigger.

Further, a clutch or similar controllable engaging-releasing element between motor 44 and cable 52 could permit the target object, once struck by the practicing user, to travel to the point of telescopic unit 36's full extension and then be rapidly drawn back to permit the user to strike the target object again. If repeatable, this would permit dynamic simulation of extended sessions of play, such as simulation of repeated back-and-forth volleying of a tennis ball, or the like. FIG. 13 shows apparatus that would permit such action, comprising inertial clutch 80; clutch return spring 82; cable trigger 84; and, toggle switch 86, wherein switch 86 is in the circuit 88 controlling power to telescopic unit motor 44. Inertial clutch 80 disengages when cable 52 plays out at high speed in response to object ball 58 being struck. Then, as cable 52's travel slows, clutch return spring 82 reengages clutch 80. If, in addition to the foregoing, control unit 70 is provided with circuitry which permits a selectively variable delay of zero to twelve seconds, or so, between the time trigger 84 trips toggle switch 86, and the time electrical power is fed to motor 44, a wide variety of actual play simulations could be devised.

Yet further, it is contemplated that it would be beneficial if telescopic unit 36 were rotatable 180° on suspension rod 32, or with suspension rod 32, to accommodate left-handed users and back-hand strokes. This rotatability can be accomplished in several ways within the skill in the art.

And, it would be advantageous to add a pair of laterally-projecting wheels 78 to the front cross bar 14 of any embodiment of the inventive apparatus in order to render it more easily movable from one location to another.

It is also observed that electromechanical apparatus 62 is as well-suited to practicing static simulations as is mechanical apparatus 10, as long as cable 52 or central rod 42 can be disengaged from motor 44.

Performance-evaluating embodiment 72 of the inventive apparatus, shown in FIG. 9, in combination with control unit 70, may give the practicing user many different kinds of feedback information on practice, performance and improvement, and may also function to entertain or challenge the practicing user. For example, video monitor 74 may be caused to display data on past performance, goals, future performance, statistics, and comparisons of these for different practicing users as well as for top competitors and professionals. Further, graphics, especially animated graphics, can broaden these possibilities to display courts, fields and courses of play, along with graphic representations of target objects, flight paths, and/or those of real or fictitious competitors as they would occur in actual play. This type of analysis and display would obviously rely heavily upon sensors embedded in the target object, and high-density data storage capabilities and high-speed data analysis in control unit 70. Sensors on the other dynamically moving and passively moving parts of apparatus 72, along with appropriate data-transport cabling, may also be desirable or required to achieve the highest quality analysis, feedback and/or challenge in using apparatus 72.

The foregoing detailed disclosure of the inventive sports training apparatus is considered as only illustrative of the preferred embodiment of, and not a limitation upon the scope of, the invention. Those skilled in the art will envision many other possible variations of the structure disclosed herein that nevertheless fall within the scope of the following claims. Examples include apparatus having different, but mechanically equivalent, elements for presenting, controlling, and/or recording movement of a target object.

And, alternative uses for this inventive apparatus may later be realized. For example, target objects simulating other sport and game equipment other than round balls may be employed. Of course, a differently-shaped object used in a manner similar to a ball, such as a shuttlecock for practicing badminton, would be contemplated. But, such target objects could also include items shaped and used very differently, such as padded punch and/or kick targets for practicing martial arts moves. Accordingly, the scope of the invention should be determined with reference to the appended claims, and not by the examples which have herein been given.

I claim:

1. Sports practice apparatus, comprising:

a. a frame;

b. a target object;

c. telescopically extensible presenting means between said target object and said frame for presenting said target object to a user; and d. means for causing said telescopically extensible presenting means, once extended to contract.

2. The apparatus of claim 1, wherein said telescopically extensible presenting means is positionable as a unit to a starting position, and said telescopically extensible presenting means is positionable as a unit to an ending position said apparatus further including means for returning said telescopically extensible presenting means as a unit to said starting position from said ending position.

3. The apparatus of claim 1, wherein said telescopically extensible presenting means includes at least three telescopically-slidable segments nested within one another along a common axis.

4. The apparatus of claim 1, wherein said frame comprises a U-shaped base portion and an upward-projecting support standard.

5. The apparatus of claim 1, further including an elongate suspension rod connecting said telescopically extensible presenting means with said frame.

6. The apparatus of claim 5, wherein said suspension rod projects generally vertically from a support arm of said frame.

7. The apparatus of claim 5, further including means for disposing said suspension rod in a generally vertical orientation before said target object is struck, wherein said means further permit said suspension rod to swing through an arc after said target object is struck.

8. The apparatus of claim 5, further including means for permitting said suspension rod to swing through an arc in a vertical plane.

9. The apparatus of claim 8, wherein said means for permitting said suspension rod to swing through an arc comprises means for grasping an end portion of said suspension rod, said grasping means being engaged with said frame such that said grasping means is rotatable about a horizontal axis.

10. The apparatus of claim 8, further including means for damping motion of said suspension rod with respect to said frame.

11. The apparatus of claim 5, further including means for permitting said suspension rod to rotate about its elongate axis.

12. The apparatus of claim 5, further including means for permitting said telescopically extensible presenting means to pivot in a plane parallel with an elongate axis of said suspension rod.

13. The apparatus of claim 12, wherein said means for permitting said telescopically extensible presenting means to pivot comprises a joint between a distal end of said suspension rod and an outer casing of said telescopically extensible presenting means.

14. The apparatus of claim 12, further including means for damping pivoting motion of said telescopically extensible presenting means with respect to said suspension rod.

15. The apparatus of claim 1, wherein said telescopically extensible means comprises a casing and a segment telescopically retractable with respect to said casing, and wherein said means for contraction comprises a tether secured to said retractable segment and means for reeling said tether and said retractable segment toward said casing.

16. The apparatus of claim 15, wherein said reeling means includes a clutch which, when disengaged, permits said tether to reel out freely, and which permits said retractable segment to be extended from said casing.

17. The apparatus of claim 1, further including means for storing information related to use of the apparatus to permit a practicing user to evaluate the user's performance in using the apparatus.

18. The apparatus of claim 17, wherein said evaluation means includes a video monitor in communication with a control unit, said control unit being in communication with sensors associated with said target object.

19. Sports practice apparatus, comprising:

a. a frame;

b. a target object;

c. telescopically extensible presenting means between said target object and said frame for presenting said target object to a user wherein said telescopically extensible means comprises a casing and at least one segment received by said casing and telescopically retractable with respect to said casing; and d. means for causing said telescopically extensible presenting means, once extended to contract wherein said means for causing contraction comprises a tether secured to said retractable segment and means for pulling said tether and said segment toward said casing.

20. Sports practice apparatus, comprising:

a. a frame;

b. a target object;

c. motion and position sensor associated with said target object;

d. telescopically extensible presenting means between said target object and said frame for presenting said target object to a user, wherein said telescopically extensible means comprises a casing and at least one segment received by said casing and telescopically retractable with respect to said casing;

e. means for causing said telescopically extensible presenting means, once extended to contract wherein said means for causing contraction comprises a tether secured to said retractable segment and means for pulling said tether and said segment toward said casing; and f. a video monitor in communication with a control unit, said control unit being in communication with said sensors.

* * * * *